United States Patent [19]

Lyman

[11] Patent Number: 4,988,216

[45] Date of Patent: Jan. 29, 1991

[54] INSULATED CONTAINER INSERTABLE INTO A BACKPACK

[76] Inventor: Philip C. Lyman, 4645 Macky Way, Boulder, Colo. 80303

[21] Appl. No.: 341,537

[22] Filed: Apr. 21, 1989

[51] Int. Cl.[5] ..... B65D 30/20; B65D 30/02; B65D 33/28

[52] U.S. Cl. ..... 383/74; 383/76; 383/86; 383/86.1; 383/110

[58] Field of Search ..... 383/86, 86.1, 74, 110, 383/76

[56] References Cited

U.S. PATENT DOCUMENTS

| | | | |
|---|---|---|---|
| 283,060 | 8/1883 | Bailey . | |
| 1,261,846 | 4/1918 | Osgood | 383/86 |
| 1,949,677 | 3/1934 | Crawford . | |
| 2,013,358 | 9/1935 | Osborne . | |
| 2,057,933 | 10/1936 | Brinkman . | |
| 2,289,254 | 7/1942 | Eagles | 383/110 |
| 2,625,695 | 1/1953 | Nicholson | 383/110 |
| 2,684,787 | 7/1954 | Charpiat . | |
| 2,730,151 | 1/1956 | Smith . | |
| 2,731,182 | 1/1956 | Higgins . | |
| 2,733,710 | 2/1956 | Zibell . | |
| 2,832,116 | 4/1958 | Clevett, Jr. et al. | 383/74 |
| 2,857,949 | 10/1958 | Ziff . | |
| 3,031,121 | 4/1962 | Chase | 383/110 |
| 3,225,806 | 12/1965 | Pollak et al. | 383/86 |
| 3,980,216 | 9/1976 | Nye . | |
| 4,197,890 | 4/1980 | Simko . | |
| 4,228,908 | 10/1980 | Tweeton . | |
| 4,375,828 | 3/1983 | Biddison . | |
| 4,421,150 | 12/1983 | Masters | 383/86 |
| 4,449,378 | 5/1984 | Thorpe . | |
| 4,513,895 | 4/1985 | Leslie . | |
| 4,537,313 | 8/1985 | Workman . | |
| 4,578,814 | 3/1986 | Skamser | 383/110 |
| 4,595,101 | 6/1986 | Rivera | 383/110 |
| 4,673,117 | 6/1987 | Calton . | |
| 4,679,242 | 7/1987 | Brockhaus | 383/110 |
| 4,706,856 | 11/1987 | Jacober . | |
| 4,721,237 | 1/1988 | Leslie . | |

*Primary Examiner*—Stephen P. Garbe
*Attorney, Agent, or Firm*—Gregg I. Anderson

[57] ABSTRACT

A thermal container for insertion into a backpack having separate attachment means for securing an integral flap and sealing means for further sealing an opening of said insert container. The container has an open position for receiving carried items and a closed position for sealing the carried items therein. The closure flap is integrally formed with a body of the container. Closure of the flap deforms the body along deformation lines, closing and opening. Selectively positionable stops drawn tightly against the closure flap seals the opening and the items carried therein. The container is insertable into any one of a number of backpacks, and the drawstring can be used as a carrying handle.

1 Claim, 2 Drawing Sheets

INSULATED CONTAINER INSERTABLE INTO A BACKPACK

BACKGROUND OF THE INVENTION

1. Field Of The Invention

The invention generally relates to insulated backpacks or insulated containers insertable into backpacks, bike packs, duffle bags and the like.

2. Description Of The Prior Art

The prior art includes many backpacks or backpack-like containers which have insulating properties. Chief among the prior art patents is U.S. Pat. No. 4,673,117, issued to J. D. Calton, which shows a backpack cooler including an insulated foam core covered on the outside with a cloth sheet. The foam core has a separate, tight-fitting lid. A separate insulated container insertable into a separate compartment of a backpack is seen in U.S. Pat. No. 4,706,856, issued to J. M. Jocober. The principal object of both Calton and Jocober is to keep carried items either warmer or cooler than the ambient conditions surrounding the backpack user.

Other insulated chests or containers carried on a person's back are seen in U.S. Pat. No. 4,449,378, issued to K. Thorpe and U.S. Pat. No. 3,980,216, issued to G. G. Nye. A separate top is used to seal the container in Nye. The patent to Thorpe shows multiple compartments having specialized uses, many of which are insulated to keep food or liquid either warm or cold.

Numerous other prior art patents show portable carriers which insulate food or liquid but which are not necessarily carried on the back. Other prior art shows portable containers, principally for liquids, having varying degrees of insulation, which are designed to be carried on a person's back, though not in association with a standard backpack.

All of the backpacks having insulation, or the containers which are insulated and used in association with backpacks in the prior art, are specifically designed and made to go with a particular backback. Heretofore, no thermal insert for a backpack has been available which is used with any one of several commercially-available backpacks. Backpacks are widely used for carrying anything from school books to camping supplies. Allowing the flexibility to convert an existing conventional packpack into an insulated backpack has not, heretofore, been available.

SUMMARY OF THE INVENTION

It is the principal object of the present invention to provide a thermal insert for a backpack wherein warm or cold items may be carried and maintained more closely to a desired temperature than without such a thermal insert.

It is a related object to provide a thermal insert for a backpack which can be used with an assortment of available conventional backpacks.

It is another object of the present invention to provide a thermal insert for a backpack which has an easily-sealed opening.

In accordance with the objects of the invention, a thermal insert or container including a bottom portion and a wall portion each comprised of an insulation layer and an outer covering layer. The container is insertable into any one of a number of types of backpacks and is loaded with carried items. Typically, the carried items will be warmer or cooler than the ambient environment, and it is desired that the thermal container maintain those items at or near their desired temperatures.

The wall portion includes an integral flap, which has the same insulation and outer covering layers as the main wall portion. A body is defined upon the connection of the bottom portion to the wall portion, the body having a top opening for receipt of the carried items. The opening is closed by pulling the flap across the opening and securing it to attachment means disposed on an opposite side of the body. The flexible body deforms along a deformation line as the flap is pulled to the attachment means to seal the top opening and secure the carried items within the container.

Additional sealing means both seal off the top opening and secure the items within a thermally-stable environment. The sealing means include locking means to secure the opening in a closed and sealed position.

Other aspects, features and details of the present invention can be more completely understood by reference to the following detailed description of the preferred embodiment, taken in conjunction with the drawings, and from the appended claims.

DESCRIPTION OF THE PREFERRED EMBODIMENT

Figure 1:
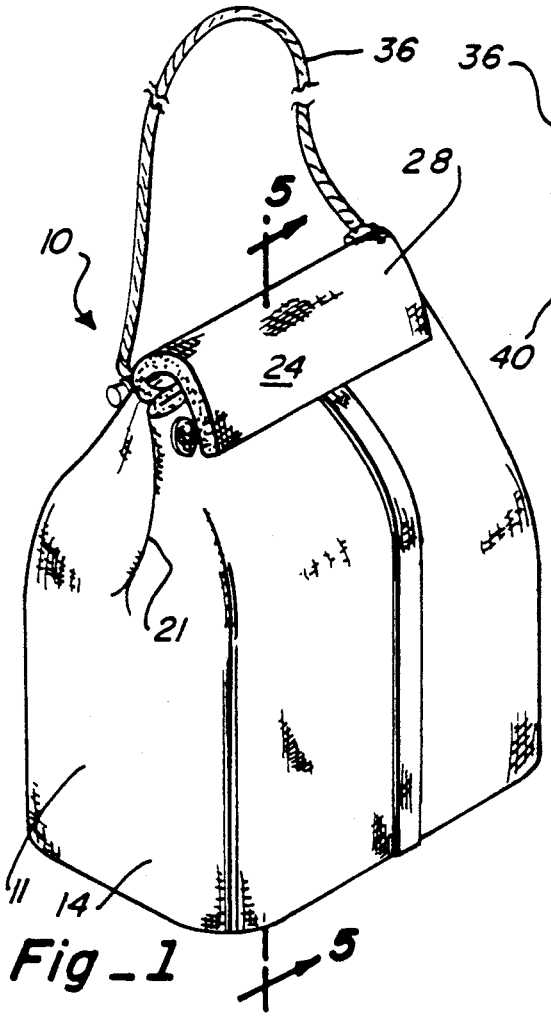
FIG. 1 is a perspective view of a thermal insert or container of the present invention with a top opening thereof closed and sealed.
Figure 2:
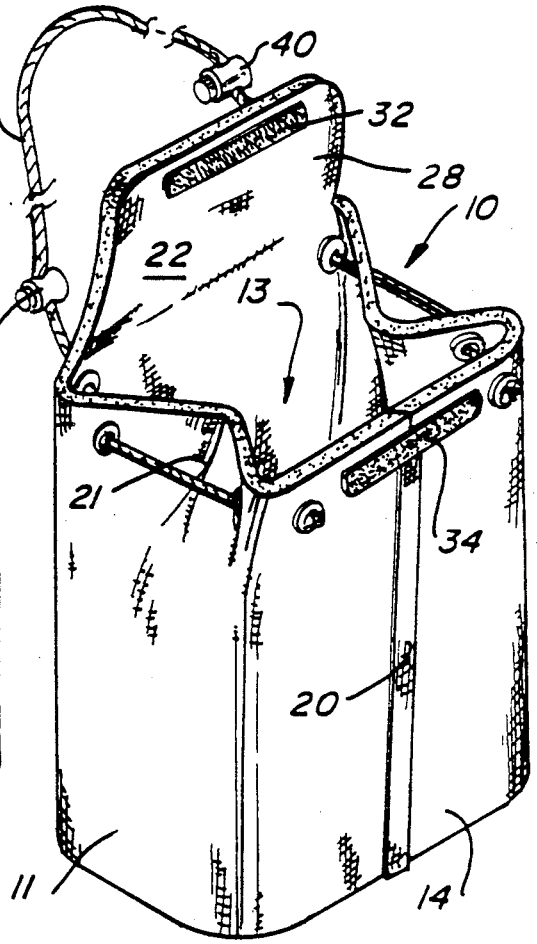
FIG. 2 is a perspective view of the invention shown in FIG. 1 with the top opening open for receipt of carried items.

A thermal insert or container 10 is shown in FIGS. 1 and 2 in an open position 22 and a closed position 24, respectively. The container 10 is insertable into any one of a number of commercially-available backpacks or other carrying case (not shown). Various carried items, which are desired to be maintained at either a warm or cold temperature, are placed in the container 10 for carrying in the backpack in an otherwise well-known manner.

Figure 3:
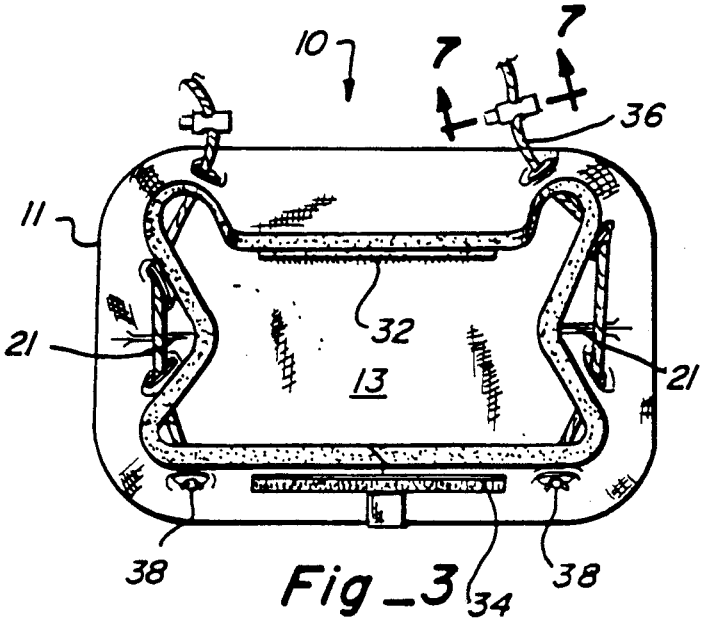
FIG. 3 is a top plan view of the open container shown in FIG. 2.

The container 10 includes a body 11 and an opening 13 (FIG. 3) through which opening 13 the carried items are inserted. The opening 13 is sealed shut by an integral closure flap 28, which flap 28, upon closure, defines the container 10 in the closed position 24. Once closed by attachment means, the opening 13 is sealed shut, the body 11 collapsing around the opening 13 along deformation line 21, by sealing means 40, in a manner to be described in detail hereinafter.

Figure 6:
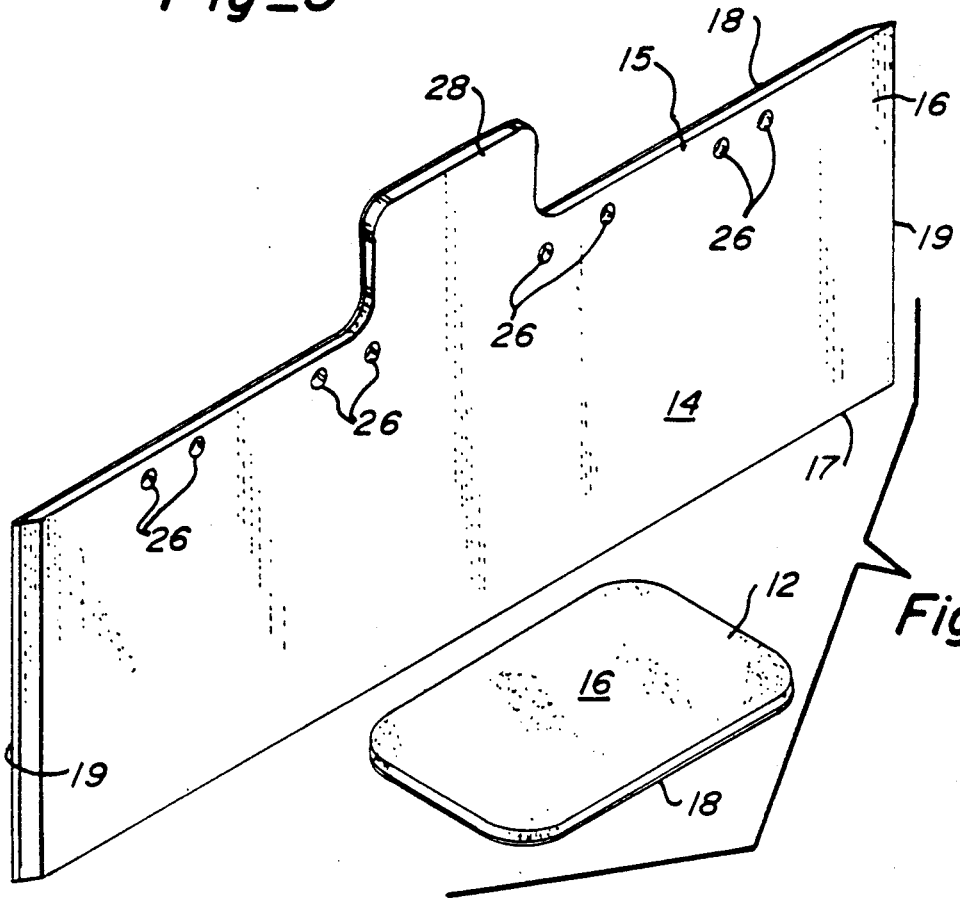
FIG. 6 is an exploded view of the construction of the invention shown in FIG. 1 showing a bottom portion and a wall portion used to construct a body of the container.

The container 10 includes a flat bottom portion 12 which is connected to a wall portion 14 to define the body 11. (FIG. 6). Each of the bottom portion and wall portions 12 and 14 include an insulation layer 16 and an outer covering layer 18. The insulation layer 16 is made of closed cell foam rubber or plastic, providing thermal insulation as well as waterproofing for any liquids that might spill within the container 10. A bottom edge 17 of the wall portion 14 connects around the periphery of the bottom portion 12 in any of a number of conventional manners, including glueing, heat or thermal welding, stapling, stitching or the like. The flap 28 projects above a top edge 15 of the wall portion while side edges 19 are joined together to complete the body 11. A seam cover 20 is attached to the body 11 over the seam left upon joining the side edges 19 together.

Figure 4:
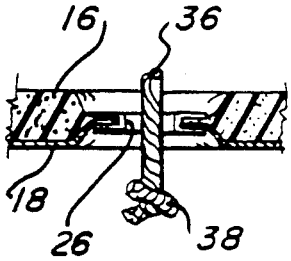
FIG. 4 is an enlarged fragmentary sectional view of a connection between a drawstring used in sealing the opening closed and a wall portion of the thermal container.
Figure 7:
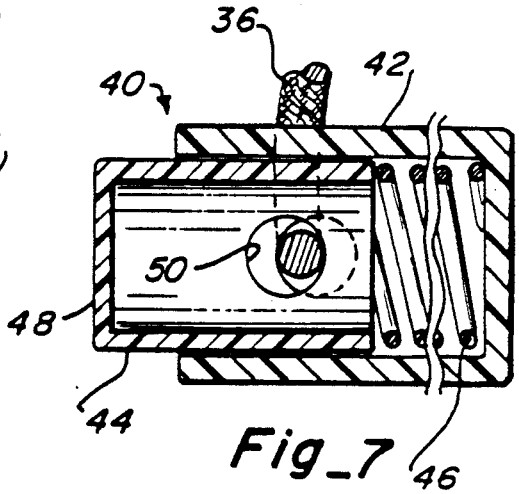
FIG. 7 is an enlarged sectional view taken in the plane of line 7—7 of FIG. 3.

Closure holes 26 are formed through the wall portion 14 for passage of a drawstring 36. Fixed or knotted ends 38 are located adjacent to two of the holes. (FIG. 4). Spring-loaded stops 40 travel along the drawstring and are locked in position relative to the drawstring 36 at the selection of the user. (FIG. 7).

The spring-loaded stops 40, which are commercially available, include a hollow outer bead 42 carrying therein a spring 46 and an inner bead 44 slideable in the outer bead 42, the inner bead 44 having a button 48 at one end thereof. A second end of the inner bead 44 abutts the spring, biasing the inner bead 44 away from the outer bead 42. A hole 50 passes through the inner and outer beads 42 and 44 through which the drawstring 36 passes. Depressing the button 48 overcomes the bias in the spring 46 and aligns the holes 50 between the inner and outer beads 42 and 44. This allows the stops 40 to be moved relative to the drawstring. Releasing the button 48 allows the bias in the spring 46 to push the inner bead 44 away from the outer bead 42 and to engage the drawstring 36, locking the stop 40 into position relative to the drawstring 36.

Figure 5:
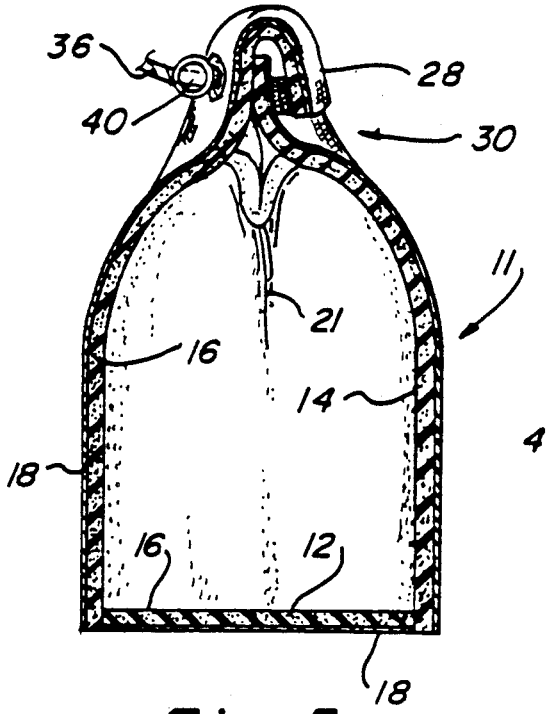
FIG. 5 is a sectional view taken in the plane of line 5—5 of FIG. 1.

The spring-loaded stops 40, in combination with the drawstring 36, comprise sealing means for totally closing the opening 13. Once the closure flap 28 has been closed, drawing the stops 40 snugly against the bottom of the closure flap 28 (FIG. 5) seals the opening 13 shut and maintains the interior of the container 10 isolated from the ambient conditions.

The closure flap 28 includes, on an inner edge thereof, a loop portion 32 of Velcro fastening material. A hook portion 34 of Velcro fastening material is connected to the body 11 of the container 10 opposite the closure flap 28. Moving the closure flap 28 over the opening 13 to a position where the loop portion 32 connects to the hook portion 34 defines means for attaching the flap 28 to the body 11 and for closing the opening 13 of the container 10. Incorporating the sealing means, as defined by the spring-loaded stops 40 and the drawstring 36, seals the opening 13 and the items carried in the container 10.

In operation, when the container 10 is opened, the inherent elasticity in the material from which the container 10 is made holds the container in the open position 22 so that the container 10 is easily filled with selected items. As the closure flap 28 is pulled over the opening 13, the elasticity in the insulation layer 16 is overcome, and the opening 13 is closed, putting the container 10 in the closed position 24.

As best seen in FIGS. 1 and 2, the open position 22 maintains a semi-rigid shape with flexibility of the wall portion 14 occurring along the deformation lines 21 set in the wall portion 14. These deformation lines 21 allow the wall portion to easily conform to the open position 22 and the closed position 24 and back.

Although the present invention has been described with a certain degree of particularity, it is understood that the present disclosure has been made by way of example, and changes in detail or structure may be made without departing from the spirit of the invention, as defined in the appended claims.

I claim:

1. A thermal container for insertion into an outer carrying case, comprising in combination:

a body formed of insulating and waterproof material having a predetermined open shape and a predetermined closed shape, said open shape having a top opening for receiving carried items, said body having an integral flap which is selectively closed over said opening by attachment means for holding said flap in position over said top opening to define said closed position, and sealing means which selectively tightens the closure of said top opening by deforming said container along deformation lines formed in said body, said sealing means further including a drawstring slideable through openings formed in said body near said top opening, said drawstring having a pair of knotted ends on one side of said second openings and stops selectively slideable along said drawstring, whereby sliding said stops into position against said flap and said knotted ends against said second openings seal said top opening into said closed position.

* * * * *